US005374216A

United States Patent [19]

Jung et al.

[11] Patent Number: 5,374,216

[45] Date of Patent: Dec. 20, 1994

[54] STUFFED FIGURE WITH ROTATING OFFSET SHAFTS TO CAUSE LIMB MOTION

[76] Inventors: Hou-Chin Jung, 51-50, Alley 85, Lane 673, Chune Cheng Road, Ten Te Village, Tainan Hsien; Pao-Feng P. Chang, 4F-1, No. 54, I Chiang St., Taipei, both of Taiwan, Prov. of China

[21] Appl. No.: 173,748

[22] Filed: Dec. 21, 1993

[51] Int. Cl.[5] ..... A63H 30/00; A63H 11/00

[52] U.S. Cl. ..... 446/175; 446/330; 446/352; 446/353

[58] Field of Search ..... 446/175, 330, 352, 353

[56] References Cited

U.S. PATENT DOCUMENTS

| | | | |
|---|---|---|---|
| 1,639,442 | 8/1927 | Strauss et al. | 446/353 |
| 1,796,483 | 3/1931 | Schoder | 446/353 |
| 2,194,537 | 3/1940 | Adams | 446/353 |
| 3,029,552 | 4/1962 | Katz | 446/453 |
| 3,456,383 | 7/1969 | Gardel et al. | 446/353 |
| 3,613,299 | 10/1971 | Amici et al. | 446/353 |
| 5,030,161 | 7/1991 | Pastor | 446/298 |
| 5,094,645 | 3/1992 | Stern et al. | 446/353 |

FOREIGN PATENT DOCUMENTS

| | | | |
|---|---|---|---|
| 1053368 | 3/1959 | Germany | 446/353 |
| 468818 | 7/1937 | United Kingdom | 446/352 |
| 2221401 | 7/1990 | United Kingdom | 446/353 |

*Primary Examiner*—Robert A. Hafer
*Assistant Examiner*—Jeffrey D. Carlson
*Attorney, Agent, or Firm*—Peterson, Wicks, Nemer & Kamrath

[57] ABSTRACT

A movable toy includes a toy body having movable hands and tail, a motor and an electric board are disposed in the toy body, a pair of barrels are located close to the hands for rotatably supporting two shafts which extend into the hands, a stub is located close to the tail portion for rotatably supporting a rod which extends into the tail portion, the shafts and the rod are coupled to the motor and driven by the motor, the hands and the tail portion are rotated when the motor is energized. A light-sensitive resistor is connected to the motor for controlling the motor.

1 Claim, 5 Drawing Sheets

STUFFED FIGURE WITH ROTATING OFFSET SHAFTS TO CAUSE LIMB MOTION

BACKGROUND OF THE INVENTION

1. Field of the Invention

The present invention relates to a toy, and more particularly to a movable toy.

2. Description of the Prior Art

Various kinds of movable toys have been developed, however, most of the toys include part of the limbs movable and include a rather complicated configuration.

The present invention has arisen to mitigate and/or obviate the afore-described disadvantages of the conventional movable toys.

SUMMARY OF THE INVENTION

The primary objective of the present invention is to provide a movable toy which includes a greatly simplified configuration and includes a movable tail portion.

In accordance with one aspect of the invention, there is provided a movable toy comprising a body including two hands, a tail portion and a head portion, stuffing materials filled in the body, a base disposed in a bottom portion of the body and including a switch provided therein, and an operating mechanism including a motor and an electric board disposed on the base, a speaker connected to the electric board for generating sounds, a pair of barrels located close to the hands of the body, a shaft rotatably supported in each of the barrels and including an extension extended into the hands respectively, a first gear fixed on the shaft, a first pulley coupled to the motor and driven by the motor, a second pulley, a first belt coupling the second pulley to the first pulley, a first pinion fixed on the second pulley, first gearing means coupling the first pinion to the first gear in order to rotate the extensions, a stub located close to the tail portion of the body, a rod rotatably supported in the stub and including a post extended into the tail portion, a second gear fixed on the rod, a third pulley coupled to the motor and driven by the motor, a fourth pulley, a second belt coupling the third pulley to the fourth pulley, a second pinion fixed on the fourth pulley, and second gearing means coupling the second pinion to the second gear in order to rotate the post, whereby, the hands and the tail portion are actuated when the motor is energized.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
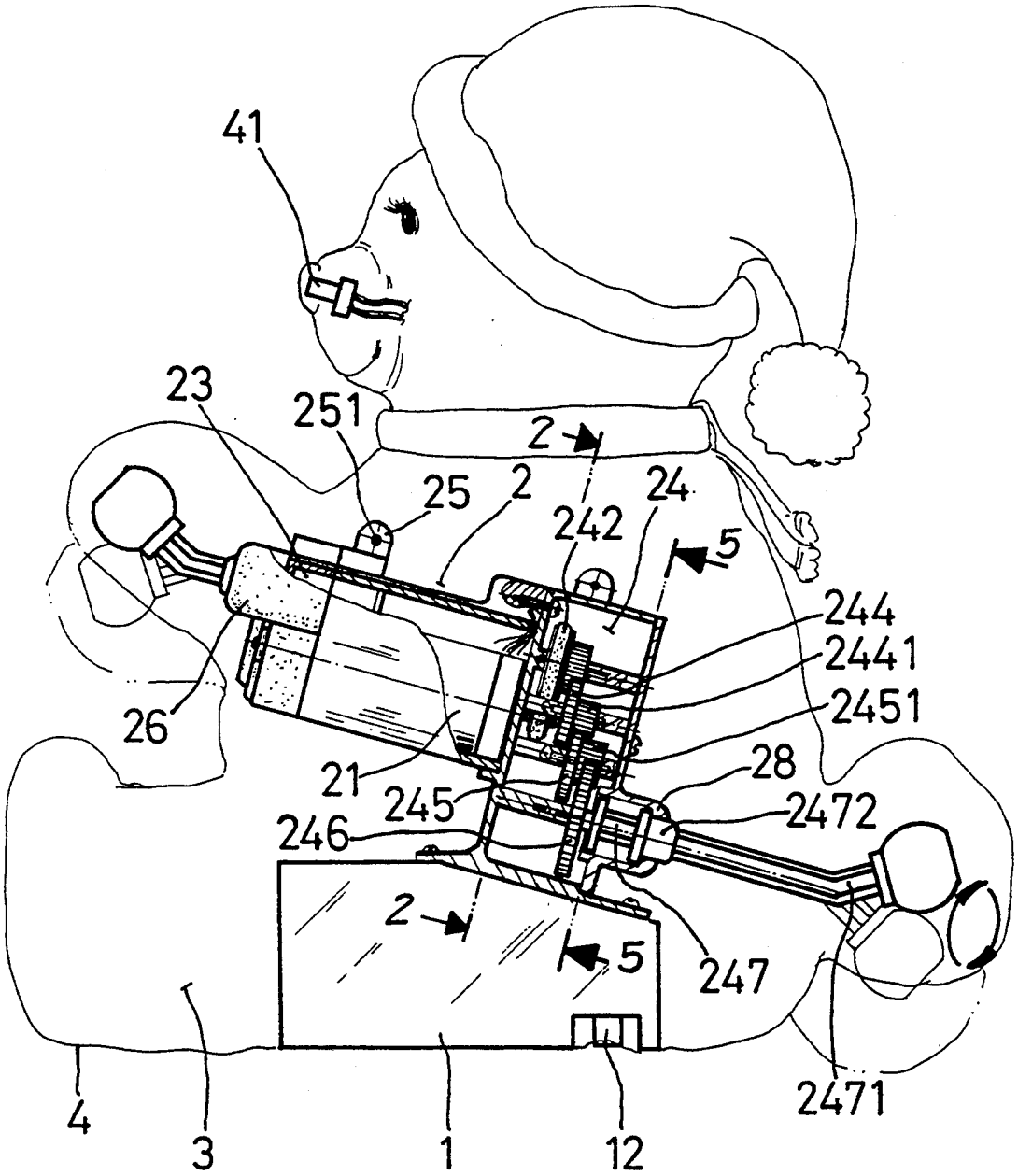
FIG. 1 is a vertical cross sectional view of a movable toy in accordance with the present invention.
Figure 2:
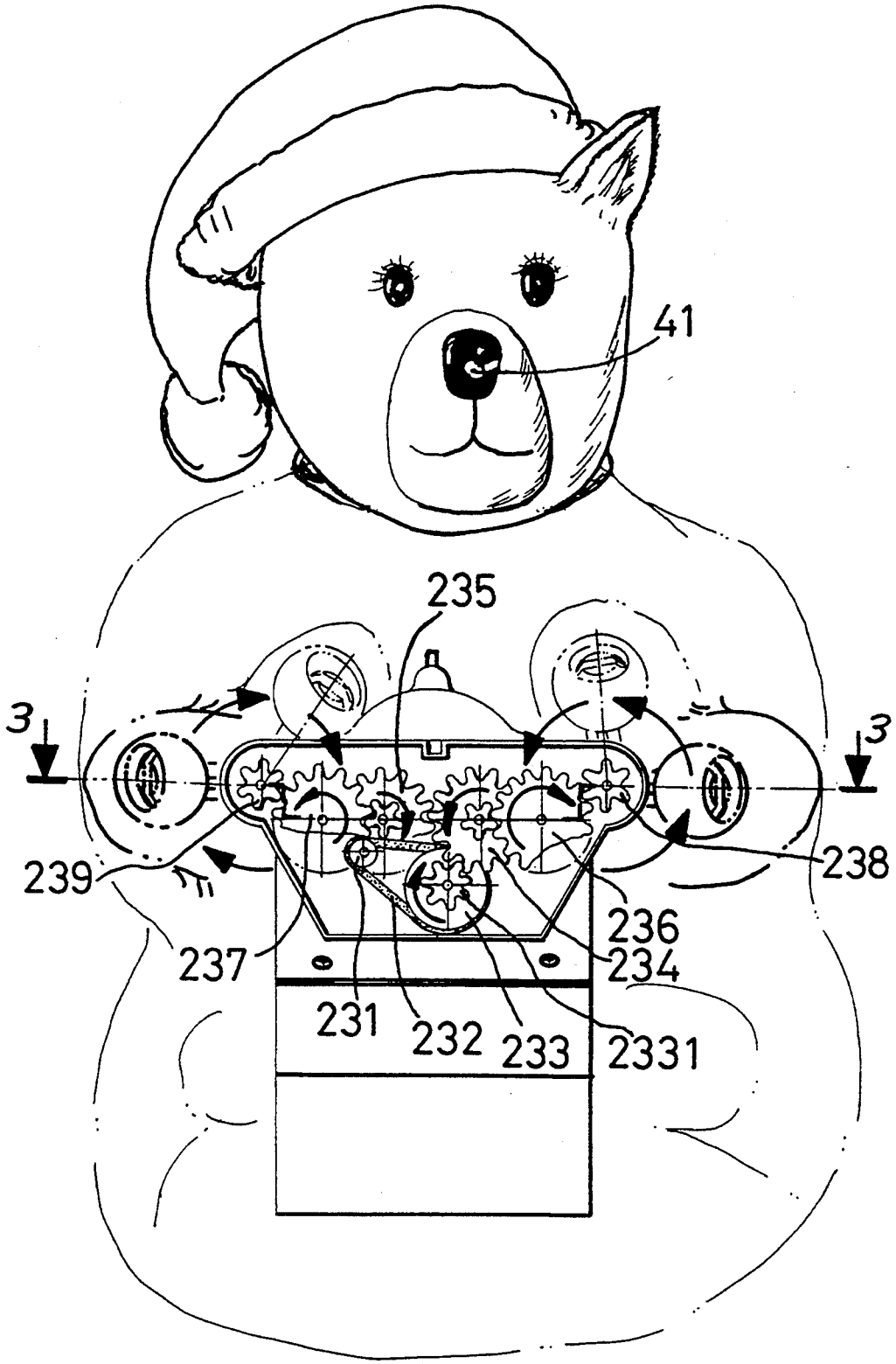
FIG. 2 is a cross sectional view taken along lines X—X of FIG. 1.
Figure 3:
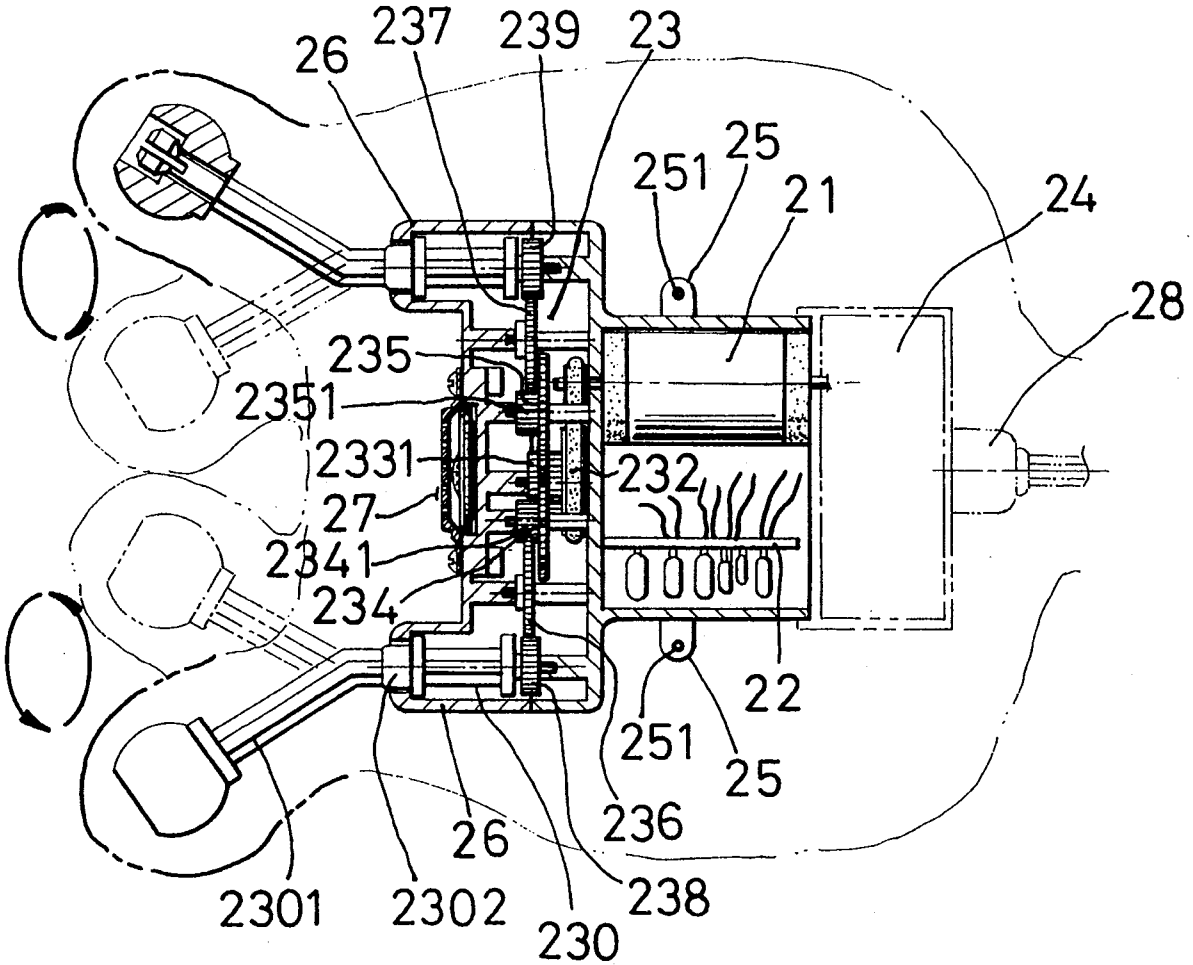
FIG. 3 is a cross sectional view taken along lines Y—Y of FIG. 2.

Referring to the drawings, and initially to FIGS. 1 to 3, a movable toy in accordance with the present invention comprises a body 4 including stuffing materials 3 filled therein, a base 1 provided in the bottom portion of the body 4 for accommodating at least one battery and having a switch 12 for operating the movable toy, and an operating mechanism 2 provided in the body 4 and fixed on the base 1 for moving the hands and the tail portion of the toy.

Figure 4:
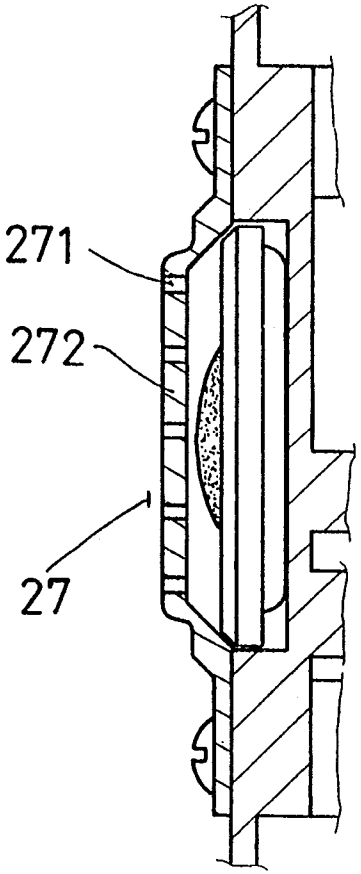
FIG. 4 is a cross sectional view illustrating the sounding portion of the toy.

The operating mechanism 2 includes a motor 21 and an electric board 22 connected to the battery 11 and energized by the battery, a first gearing device 23 provided for operating the hands of the toy, a second gearing device 24 provided for operating the tail portion of the toy, a number of ears 25 each having a hole 251 formed therein for being secured to the stuffing materials 3 by threading operations, for example, so as to maintain the operating mechanism 2 in place within the body 4, a pair of barrels 26 extended forward therefrom, a speaker 27 for sounding purposes, and a stub 28 extended rearward therefrom. As shown in FIG. 4, the speaker 27 is secured in place by a cap 272 which includes a plurality of holes 271 formed therein.

As best shown in FIGS. 2 and 3, the first gearing device 23 includes a pulley 231 secured to the spindle of the motor 21 and coupled to a follower pulley 233 with a belt 232, a pinion 2331 fixed to the pulley 233 for driving a gear 234 which then drives another gear 235, two pinions 2341, 2351 fixed on the gears 234, 235 for driving other gears 236, 237 respectively, a shaft 230 rotatably supported in each of the barrels 26 and having a bearing means 2302 engaged with the barrels 26 and including an extension 2301 extended into the hands of the body 4, and a pinion 238, 239 fixed on each of the shafts 230 for engaging with the gears 236, 237 respectively, such that the extensions 2301 can be rotated by the motor 21, it is preferable that the extensions 2301 are bent and inclined relative to the shafts 230 respectively.

Figure 5:
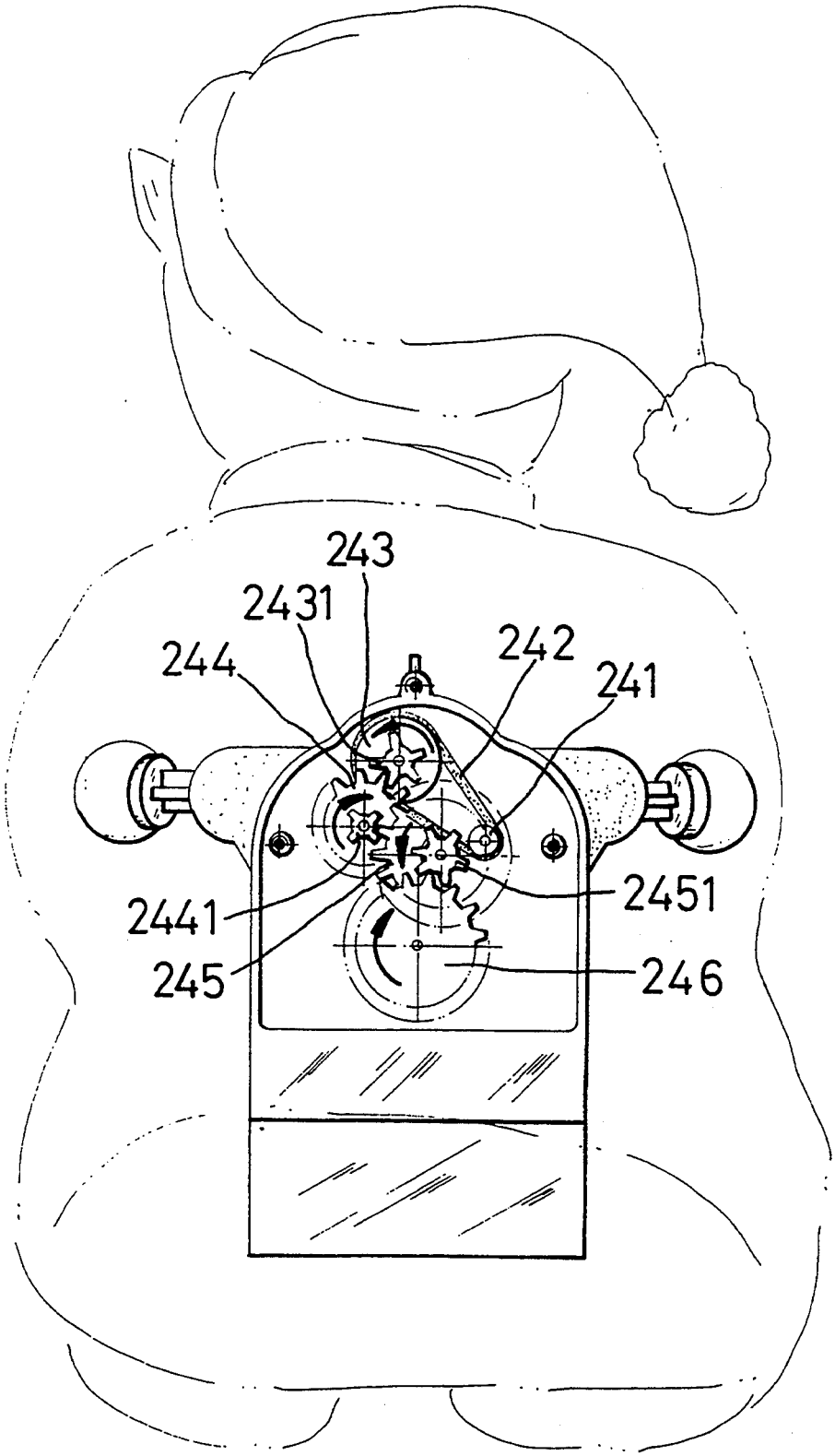
FIG. 5 is a cross sectional view taken along lines Z—Z of FIG. 1.

Referring next to FIGS. 1 and 5, the second gearing device 24 includes a pulley 241 secured to the spindle of the motor 21 and coupled to a follower pulley 243 with a belt 242, a pinion 2431 fixed to the pulley 243 for driving a gear 244 which includes a pinion 2441 fixed thereon for driving another gear 245, which also includes a pinion 2451 fixed thereon for driving another gear 246, the gear 246 is fixed on a rod 247 which is rotatably supported in the stub 28 by a bearing means 2472 and which includes a post 2471 extended into the tail portion of the body 4, such that the post 2471 can be rotated by the motor 21, it is preferable that the post 2471 is bent and inclined relative to the rod 247.

In operation, when the switch 12 is turned on, the motor 21 is energized in order to rotate the extensions 2301 and the post 2471 such that the hands and the tail portion of the toy can be moved. Optionally, a light-sensitive resistor 41 is provided in the nose of the toy and connected to the electric board 22 and arranged such that the toy can be moved after the light-sensitive resistor 41 is knocked or pressed, shaded by suitable plates or boards or by the shadow of the users, or lighted by suitable light sources.

Accordingly, the movable toy in accordance with the present invention includes a greatly simplified configuration and includes a movable tail portion.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A movable toy comprising a body including two hands, a tail portion and a head portion, stuffing materials filled in said body, a base disposed in a bottom portion of said body and including a switch provided therein, and an operating mechanism including a motor and an electric board disposed on said base, a speaker connected to said electric board for generating sounds, a light-sensitive resistor disposed in said head portion of said body and connected to said electric board in order to control said motor, a pair of barrels located close to said hands of said body, a shaft rotatably supported in each of said barrels and including an extension extended into said hands respectively, a first gear fixed on said shaft, a first pulley coupled to said motor and driven by said motor, a second pulley, a first belt coupling said second pulley to said first pulley, a first pinion fixed on said second pulley, first gearing means coupling said first pinion to said first gear in order to rotate said extensions, a stub located close to said tail portion of said body, a rod rotatably supported in said stub and including a post extended into said tail portion, a second gear fixed on said rod, a third pulley coupled to said motor and driven by said motor, a fourth pulley, a second belt coupling said third pulley to said fourth pulley, a second pinion fixed on said fourth pulley, and second gearing means coupling said second pinion to said second gear in order to rotate said post, whereby said hands and said tail portion are actuated when said motor is energized.

* * * * *